United States Patent [19]

Kern

[11] 4,403,738

[45] Sep. 13, 1983

[54] DEVICE FOR SPRAYING AQUEOUS MIXTURES

[75] Inventor: Hans Kern, Vachendorf, Fed. Rep. of Germany

[73] Assignee: Lang Apparatebau GmbH, Siegsdorf, Fed. Rep. of Germany

[21] Appl. No.: 373,296

[22] Filed: Apr. 29, 1982

[30] Foreign Application Priority Data

May 8, 1981 [DE] Fed. Rep. of Germany ..... 3118207

[51] Int. Cl.[3] ..... B05B 7/26

[52] U.S. Cl. ..... 239/313; 239/323

[58] Field of Search ..... 222/94, 386.5; 239/310, 239/315, 316, 322, 323, 327, 313, 61, 71; 417/390, 403

[56] References Cited

U.S. PATENT DOCUMENTS

| | | | |
|---|---|---|---|
| 2,153,240 | 4/1939 | Dailey et al. | 239/71 |
| 2,199,110 | 4/1940 | Metz | 239/323 |
| 3,338,523 | 8/1967 | Tibbitt | 239/61 |
| 4,030,857 | 6/1977 | Smith, Jr. | 417/390 |
| 4,197,994 | 4/1980 | Liedberg | 239/61 |
| 4,364,516 | 12/1982 | Rhoades et al. | 239/323 |

*Primary Examiner*—John J. Love
*Assistant Examiner*—Jon M. Rastello
*Attorney, Agent, or Firm*—Hammond & Littell, Weissenberger and Muserlian

[57] ABSTRACT

This invention relates to an improved sprayer means wherein the improvement comprises (a) a pressurized water feed, having a minimum pressure valve unit and leading to the mixing chamber of the nozzle spray head, which water feed is fed first to a water motor provided with a drive piston driven by the pressure of the inflowing water and then to a double-action metering pump having a metering piston coupled with said drive piston of the water motor, the cross-sectional area of the metering piston and the cross-sectional area of the drive piston being in a predetermined ratio;

(b) a flexible container for chemicals residing in a detachable rigid vessel connected to a metering outlet line of the metering pump, said flexible container being connected by the mixing chamber of the nozzle spray head by a container outlet valve and a container line, the chemicals being displaced from the flexible container by water metered through the metering outlet line into the vessel; and (c) a feedback line leading from the cylinder of the metering pump to a pressure water connection valve that is capable of closing in the event of overpressure in the metering pump to shut off inflowing pressurized water.

8 Claims, 1 Drawing Figure

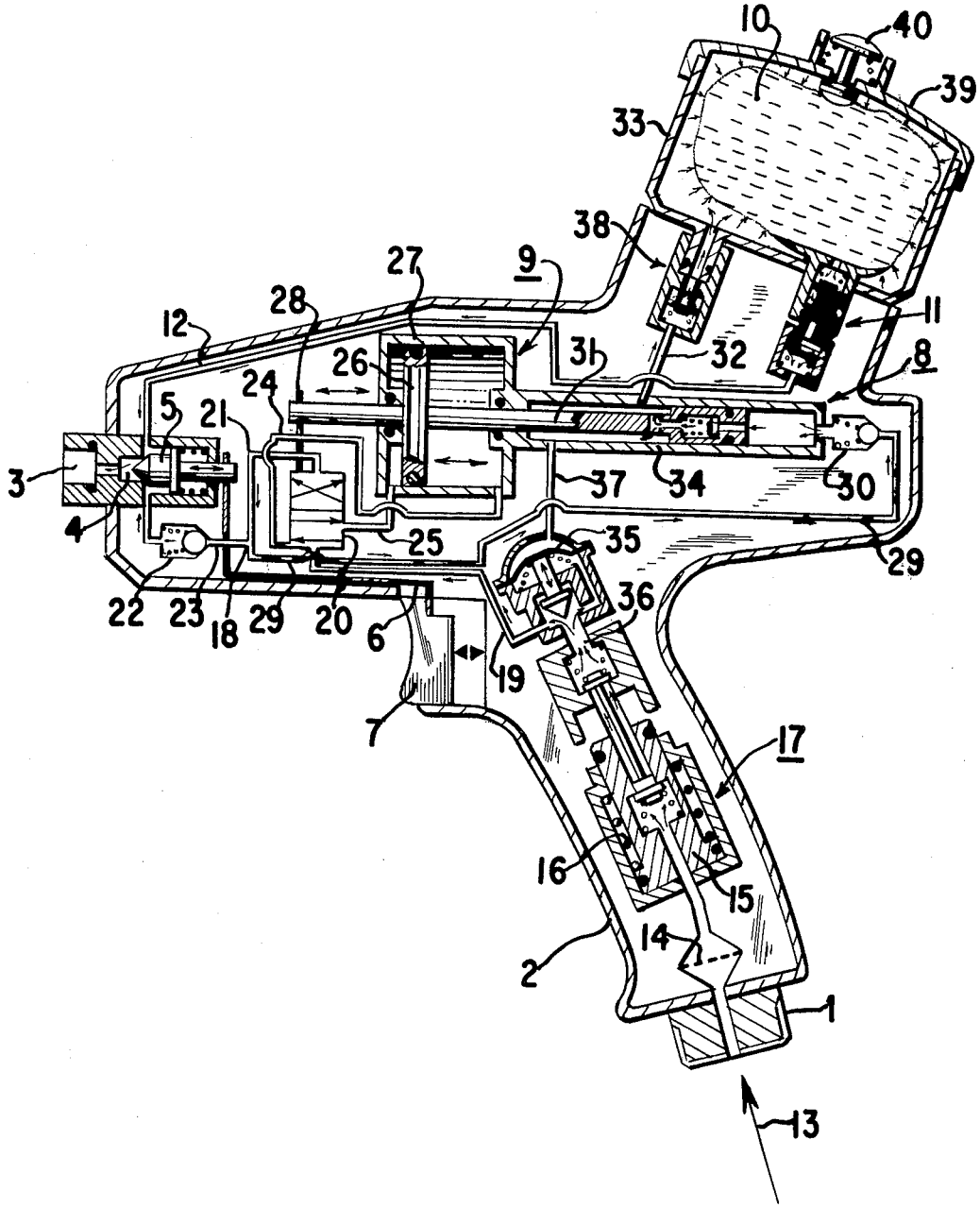
10
40
39
33
38
27
9
28
11
12
26
31
32
8
24
5
21
3
37
34
30
4
25
35
29
22
23
18
29
20
6
36
19
7
17
16
15
14
2
1
13

DEVICE FOR SPRAYING AQUEOUS MIXTURES

FIELD OF THE INVENTION

This invention relates to a means for spraying aqueous mixtures. More particularly, this invention relates to a spraying means having a mixing chamber and a metering pump with pump drive for the quantitatively proportional metering of a chemical concentrate from a concentrate vessel into a stream of water in the mixing chamber.

BACKGROUND OF THE INVENTION

Spraying devices of conventional type, for example, injector sprayers or diaphragm metering equipment, meter relatively imprecisely, that is, as the water flow quantity changes, and as the water flow pressure also changes, the percentage admixture of the dosing chemical changes. The equipment also lacks a shut-off in case of a deficiency of chemical or a drop of water pressure.

In the particular case of portable sprayers used for plant protection, that is, for spraying plants with insecticides or the like, a chemical mixture present in a pressure tank is sprayed by air pressure via a hand nozzle. A disadvantage here is that when the chemical is changed, the tank must be thoroughly cleaned with water. Due to the large internal surface of the tanks and the chemicals that adhere thereto, a relatively large quantity of the chemical is removed during cleaning. This means not only a considerable loss of expensive materials but also pollution of the ground water.

In addition, electrical and mechanical metering pumps have been used for quantity-proportional admixing of a concentrate to a stream of water. A disadvantage of these pumps is that the pump elements, such as the piston and membrane, that is, dynamically pressurized parts, come in direct contact with the respective concentrates. Besides, the power consumption of the pumps is very high, especially when the ratio of concentrate to water is high, because the pressure of the concentrate must be increased from atmospheric pressure to the water system pressure for metering.

Thus, there has been a need to develop an apparatus of the above-mentioned kind with which sprays, such as plant protectants or disinfectants, can be quantity-proportionally metered and sprayed in a manner independent of pressure and rate of flow. In particular, the following requirements should be fulfilled:

1. A given concentration must remain constant during water pressure fluctuations and water flow fluctuations. Also, the concentrate/water mixture must be constant at all times without dosage divergence;
2. It must be possible to operate the device only at a water pressure at which a satisfactory spray pattern can be produced with the nozzle spray head;
3. Upon a deficiency or depletion of chemical, the device must shut off automatically;
4. It must be possible to recover unconsumed concentrate;
5. The force required for metering must be held to a minimum to improve the total pressure loss of the device, and it must be possible to draw the metering energy from the existing water pressure;
6. When chemicals are changed, it must be possible to clean the device easily, in particular, to rinse it with water;

7. It must be possible to make the device portable or stationary;
8. It must be possible to empty the concentrate container completely during operation of the device;
9. The metering pump elements should not come into contact with the concentrate; and
10. It must not be possible to operate the metering deice without the attachment of the vessel intended to receive concentrate.

OBJECTS OF THE INVENTION

It is an object of this invention to provide a novel spraying means.

It is also an object of this invention to provide a spraying means for chemicals meeting the requirements set forth above.

It is a further object of the invention to provide a spraying means with a connection to inflowing water under pressure, a nozzle spray head with mixing chamber and outlet valve that is opened and closed by a trigger means, and a metering pump with pump drive for the quantity-proportional metering of a chemical from a chemical container into a stream of water in the mixing chamber, wherein (a) a pressurized water feed, having a minimum pressure value unit and leading to the mixing chamber of the nozzle spray head, is fed first to a water motor provided with a drive piston driven by the pressure of the inflowing water and then to a double-action metering pump having a metering piston coupled with said drive piston of the water motor, the cross-sectional area of the metering piston and the cross-sectional area of the drive piston being in a predetermined ratio;

(b) a flexible container for chemicals residing in a detachable rigid vessel connected to a metering outlet line of the metering pump, said flexible container being emptied via a container outlet valve and a container line into the mixing chamber of the nozzle spray head by displacement by means of water metered through the metering outline line; and (c) a feedback line leading from the metering pump cylinder to a pressure water connection valve that closes in case of overpressure in the metering pump to shut off inflowing water.

These and other objects of the invention will become more apparent in the discussion below.

BRIEF DESCRIPTION OF THE DRAWING

A cross-sectional view of one embodiment of a spraying means according to the invention is set forth in the drawing.

DETAILED DESCRIPTION OF THE INVENTION

Applicants have developed a sprayer means which meets the above-mentioned requirements. According to the invention, the spray means is characterized as follows:

(a) a pressurized water feed, having a minimum pressure valve unit (low-pressure pass) and leading to the nozzle spray head, is first fed to a water motor provided with a drive piston driven by the pressure of the inflowing water and then to a double-action metering pump with the metering piston coupled with said drive piston of the water motor, the cross-sectional area of the metering piston and the cross-sectional area of the drive piston being in a predetermined ratio;

(b) a flexible container for chemicals residing in a detachable rigid vessel connected to the outlet of the metering pump, said flexible container being emptied via a container outlet valve and via a container line into the mixing chamber of the nozzle spray head by displacement by means of the water to be metered through the metering outline line; and (c) a feedback line leading from the metering pump cylinder to a valve of the pressure water connection to be closed in case of overpressure in the metering pump to shut off inflowing water.

The minimum pressure valve unit preferably contains a valve piston which shuts off the water inflow from the pressure water connection below a given water pressure by the force of an elastic spiral spring. The pressure of the water from the water connection or the water system pressure inside the sprayer, respectively, need not, as a rule, be reduced. The rigid vessel which contains the chemical, especially in a flexible bladder, preferably of a one-way design, can therefore be pressurized during operation with the water system pressure.

A quantity-proportional metering and spraying independent of pressure and rate of flow is especially achieved by means of the water motor which drives the metering pump and is itself driven by the water pressure, as well as by the separation of water and chemical in the metering pump arrangement and by the feedback line which upon overpressure in the metering pump shuts off the main water connection via a valve.

Preferably the pressure water feed contains a multiple-way valve, in particular a 4/2-way valve, with a common outlet to the nozzle spray head and to the metering pump as well as with additional outlets—to be pressurized alternately—to the two sides of the drive piston of the water motor. Actually the suction line of the metering pump, that is, the branch line leading to this pump, can be connected to the pressure water feed before or after the multiple-way valve. When connected after the multiple-way valve, in particular a 4/2-way control unit, the differential pressure built up during operation of the equipment cannot influence the metering either. This connection is therefore preferred.

Applicants' invention is explained in more detail in the embodiment represented by the drawing. In the drawing, the spraying means comprises a pressure water connection 1 at handle 2; a spray head connection 3 with mixing chamber 4 and actuating valve 5, connected to linkage 6 and trigger 7; and a metering pump designated 8, as a whole, with a pump drive consisting of water motor designated 9, as a whole, for the quantity-proportional metering of a chemical or chemical concentrate. The chemical is drawn from a flexible container comprising a one-way bladder 10 via a container outlet valve 11 and a container line 12 into the mixing chamber 4. The chemicals are supplied to the one-way bladder 10 as a liquid or as a concentrate in a solvent such as water.

In the handle 2, a piston 15 is opposed by the force of the spring 16 to the water coming from arrow direction 13 (with interposed fine sieve 14) in such a way that the water under pressure can flow into the apparatus only after a certain threshold or minimum pressure has been exceeded. The details of minimum pressure unit designated 17, as a whole, are evident directly from the drawing.

After the minimum pressure valve unit 17, the feed water line 19 leads to a 4/2-way valve 20. Valve 20 has a first outlet line 21 with a branch line 23 containing a junction 18 and a check valve 22, to the mixing chamber 4, as well as two additional outlet lines 24 and 25, to be pressurized alternately, to both sides of the drive piston 26 in the cylinder 27 of the water motor 9. By the piston 26 the 4/2-way valve 20 can be switched through a linkage 28 as the piston moves back and forth, said linkage causing the pressure in outlet lines 24 and 25 to alternate.

From junction 18 the water under pressure inflows a second branch line 29 which leads via a check valve 30 to the double-action metering pump 8. The metering piston 31 of pump 8 is rigidly coupled with the piston 26 of the water motor. It should be noted that the ratio of the cross-sectional area of piston 26 of the water motor to the cross-sectional area of piston 31 of the metering pump is to be fixed at a predetermined value. Preferably the ratio is from about 10:1 to 100:1, more preferably from about 25:1 to 60:1. The remaining details of the metering pump 8 are evident from the drawing.

In addition, a one-way bladder 10 functions as a flexible container for chemicals placed in a rigid vessel 33 (having rigid walls), which is connected to the metering outlet line 32 of the metering pump 8 containing a valve 38 and to container line 12 containing container valve 11. Vessel 33 has a tightly fitting, removable cover 39, which cover contains a venting valve 40. Water metered in through valve 38 from the metering pump 8 displaces chemical or chemical concentrate in bladder 10, which chemical or chemical concentrate then travels through container outlet valve 11 and container line 12 to mixing chamber 4.

The valve 38 inserted in the metering outlet line 32 and the container outlet valve 11 in container line 12 each close when vessel 33 is removed and open when the vessel 33 is attached. Valve 11 and bladder 10 are so constructed that valve 11 operates with bladder 10 either present or removed.

Another feature of the invention consists of the feedback line 37 which leads from the metering pump cylinder 34 to a membrane valve or piston valve 35 of the pressure water feed line 36, which valve closes in case of overpressure in the metering pump 8 or in the rigid vessel 33 pressurized with water from the metering pump 8 or when valve 38 is closed.

The above requirements for a suitable spraying means are accordingly solved by the invention in the following manner:

1. A set, that is, predetermined, concentration remains constant in case of pressure fluctuations because the cross-sectional areas of the drive piston 26 of the water motor 9 and of the metering piston 31 of the metering pump 8 are in a certain ratio, for example, about 50:1. During switching via the linkage 28 by means of the 4/2-way valve 20, pressure and water-flow fluctuations are compensated by slower or faster motion of the stroke drive. The concentrate/water mixture is constant at all times without dosage divergence, because with the fixed piston cross-sectional area ratio and rigid coupling between the drive piston 26 and metering piston 31, characteristic of the double-action metering pump 8, the respective metering of water into vessel 33 via valve 38 of line 32 occurs at every movement of the drive piston 26 and thus the chemical or chemical concentrate contained in the bladder 10 is displaced proportionally to the quantity of water metered in.

2. Due to the minimum pressure valve unit 17, consisting essentially of the piston 15 and spiral spring 16, the sprayer can be pressurized with water and then be set in operation only at a defined minimum pressure. Accordingly, the apparatus is automatically taken out of operation by the unit 17 when the water pressure drops below the threshold pressure.
3. The apparatus also shuts off in case of a deficiency of chemical, because, with the chemical bladder 10 emptied, an overpressure is created in vessel 33, which via line 32, metering cylinder 34, and feedback line 37 acts on the membrane valve 35 in such a way that the water feed line 36 is closed.
4. As an unemptied chemical bladder 10 can be removed at any time from vessel 33, for example, by removing the cover 39 with venting valve 40 of vessel 33, unconsumed chemical or chemical concentrate can be returned to a supply during operation of the apparatus. It should be noted that either the vessel 33 should first be separated from the sprayer itself or the pressure water connection 1 should be disconnected from the water feed source.
5. The force required for metering is very low, as the chemical or chemical concentrate in vessel 33 is obviously under the pressure of the water system during operation and thus water must be introduced only into a space of equal pressure in metering. Because of the double-action drive of the metering pump 8, the metering energy is drawn from the existing water pressure.
6. The apparatus can be washed/rinsed without a problem with the vessel 33 (cartridge) attached, when the concentrate bladder 10 is not plugged in, because the water metered in then rinses, among other things, the container outlet, or chemical metering, line 12.
7. The embodiment of the invention in the drawing comprises manual equipment designed as spraygun with pressure water connection 1 being connected to, for example, a water hose. Naturally, the spraying means of the invention can also be designed as a stationary apparatus.
8. As the rigid vessel 33 can gradually be filled with water completely during operation of the apparatus through the metering in of water via line 32, the one-way bladder 10 is thus ultimately completely deflated so that complete evacuation of the chemical bladder inserted is ensured.
9. As is no doubt evident from the preceding description and from the drawing, the elements of the metering pump 8 come in contact only with water, as the metering occurs indirectly on the displacement principle—as in a membrane pump. The separation between water and chemical, that is, the "membrane", is brought about by the bladder 10, which is particularly a one-way container.
10. The valve 38 provided in the line 32 between metering pump 8 and vessel 33 is expediently formed in such a way that it can be opened only after vessel 33 has been attached. The metering device can then not be operated without the vessel 33 for if vessel 33 is not attached, the metering pump 8 will, similarly to the situation when vessel 33 completely fills with water and with the bladder deflated, build up—with valve 11 closed—an overpressure which leads via the feedback line 37 and the membrane valve 35 to the closing of the water inflow line 36.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. In a spraying means having a connection to inflowing water under pressure, a nozzle spray head with mixing chamber and outlet valve that can be opened and closed by a trigger means, and a metering pump with pump drive for the quantity-proportional metering of a chemical from a chemical container into a stream of water in the mixing chamber, the improvement which comprises (a) a pressurized water feed, having a minimum pressure valve unit and leading to the mixing chamber of the nozzle spray head, which water feed is fed first to a water motor provided with a drive piston driven by the pressure of the inflowing water and then to a double-action metering pump having a metering piston coupled with said drive piston of the water motor, the cross-sectional area of the metering piston and the cross-sectional area of the drive piston being in a predetermined ratio;

(b) a flexible container for chemicals residing in a detachable rigid vessel connected to a metering outlet line of the metering pump, said flexible container being connected to the mixing chamber of the nozzle spray head by a container outlet valve and a container line, the chemicals being displaced from the flexible container by water metered through the metering outlet line into the vessel;

(c) a feedback line leading from the cylinder of the metering pump to a pressure water connection valve that is capable of closing in the event of overpressure in the metering pump to shut off inflowing pressurized water.

2. The sprayer of claim 1, wherein the minimum pressure valve unit comprises a piston activated by the force of an elastic spiral spring which shuts off the water inflow from the pressure water connection if the water pressure is below a predetermined level.

3. The sprayer of claim 1, wherein the flexible container is a one-way bladder.

4. The sprayer of claim 1, wherein during operation the rigid vessel containing said flexible container is under the system pressure resulting from the inflowing pressurized water.

5. The sprayer of claim 1, wherein there is a valve in the connecting line between the metering pump and the rigid vessel, which valve closes when the rigid vessel is detached.

6. The sprayer of claim 1, wherein there is a multiple-way valve in the pressurized water feed line having an outlet to the mixing chamber of the nozzle spray head and two separate outlets connected to the water motor.

7. The sprayer of claim 6, wherein the multiple-way valve is a 4/2-way vlave.

8. The sprayer of claim 6, wherein the valve contains a linkage means which causes the outlets to the water motor to be pressurized alternately.

* * * * *